US008793919B1

(12) United States Patent
Probst, Jr. et al.

(10) Patent No.: US 8,793,919 B1
(45) Date of Patent: Aug. 5, 2014

(54) MULTI-TOOL AND APPLICATIONS THEREOF

(71) Applicants: Theodore Probst, Jr., Elmont, NY (US); Eric A Probst, Bostic, NC (US)

(72) Inventors: Theodore Probst, Jr., Elmont, NY (US); Eric A Probst, Bostic, NC (US)

( * ) Notice: Subject to any disclaimer, the term of this patent is extended or adjusted under 35 U.S.C. 154(b) by 0 days.

(21) Appl. No.: 13/799,605

(22) Filed: Mar. 13, 2013

(51) Int. Cl.
*F41A 15/00* (2006.01)
*F41C 27/00* (2006.01)

(52) U.S. Cl.
CPC ..... *F41C 27/00* (2013.01)
USPC ..... 42/108; 42/90; 81/3.09; 81/3.55

(58) Field of Classification Search
CPC ..... F41C 27/00; F41A 9/83; F41A 35/00
USPC ..... 42/108, 90; 81/3.09, 3.55
See application file for complete search history.

(56) References Cited

U.S. PATENT DOCUMENTS

| | | | | |
|---|---|---|---|---|
| 2,455,496 | A * | 12/1948 | Kaskouras | 30/413 |
| 6,360,444 | B1 * | 3/2002 | Fluhr et al. | 30/366 |
| 7,637,049 | B1 * | 12/2009 | Samson et al. | 42/108 |
| 7,712,243 | B2 * | 5/2010 | Morando | 42/108 |

* cited by examiner

*Primary Examiner* — J. Woodrow Eldred
(74) *Attorney, Agent, or Firm* — John P. Zimmer; Smith Moore Leatherwood LLP

(57) ABSTRACT

In one aspect, magazine floor plate removal tools for removing the floor plate of a firearm magazine are described herein, the floor plate defining a hole and the magazine defining a surface adjacent the floor plate. In some embodiments, the tool comprises a handle having a first end and a second end, and a first gripping member that grips the firearm magazine. The gripping member comprises a first arm extending from the first end of the handle and a second arm extending from the first end of the handle. The terminus of the first arm comprises an elongated first pin that has a long axis and engages the hole of the floor plate. The terminus of the second arm comprises a first engagement surface that is positioned substantially parallel to the long axis of the first pin and engages the surface of the magazine adjacent the floor plate.

12 Claims, 6 Drawing Sheets

MULTI-TOOL AND APPLICATIONS THEREOF

FIELD

This invention relates to multi-tools, and, in particular, to multi-tools for removing the floor plate of a firearm magazine.

BACKGROUND

Firearm magazines such as pistol magazines can include a floor plate or base plate. To clean, repair, or otherwise maintain or modify the magazine, it is sometimes necessary to remove the floor plate of the magazine. However, some firearm magazines include floor plates that are difficult and/or time-consuming to remove. Moreover, in some instances, a user can inadvertently damage the magazine when removing or attempting to remove the floor plate. In some cases, the foregoing difficulties can be encountered when using a general purpose tool such as a punch or screwdriver, or even when using a custom tool provided by the firearm magazine manufacturer for the express purpose of removing the magazine floor plate.

Therefore, improved tools for use with firearms and firearm magazines are desired.

SUMMARY

In one aspect, tools are described herein which, in some embodiments, may provide one or more advantages compared to some other tools. For instance, in some embodiments, a tool described herein can be used to remove the floor plate of a firearm magazine in a safer, simpler, faster, and/or more efficient manner. In addition, in some instances, a tool described herein can also be used for other cleaning, repair, and/or maintenance tasks, such as cleaning the interior of a firearm magazine and/or removing one or more other pins or screws of a firearm or firearm magazine. Moreover, some tools described herein can be used with a magazine comprising a floor plate that is removed using a hole in the floor plate, such as a GLOCK® magazine.

In some embodiments, a magazine floor plate removal tool for removing the floor plate of a firearm magazine is described herein. The floor plate defines a hole and the magazine defines a surface adjacent the floor plate. In some embodiments, the tool comprises a handle having a first end and a second end, and a first gripping member that grips or receives the firearm magazine. The gripping member comprises a first arm extending from the first end of the handle and a second arm extending from the first end of the handle. The terminus of the first arm comprises an elongated first pin or dowel that has a long axis that can engage the hole of the floor plate of the magazine. The terminus of the second arm comprises a first engagement surface that is positioned substantially parallel to the long axis of the first pin and can engage the surface of the magazine adjacent the floor plate. In addition, the first pin and the first engagement surface are separated by a first distance. The first distance, in some cases, is configured to receive the firearm magazine.

Moreover, in some embodiments, a tool described herein can further comprise a second gripping member. The second gripping member comprises a third arm extending from the second end of the handle and a fourth arm extending from the second end of the handle. The terminus of the third arm comprises a second elongated pin having a long axis. The terminus of the fourth arm comprises a second engagement surface positioned substantially parallel to the long axis of the second pin. The second pin and the second engagement surface are separated by a second distance. In some instances, the second distance differs from the first distance. Additionally, in some embodiments, the second distance is configured to receive a second firearm magazine differing in size from the firearm magazine engaged or received by the first gripping member of the tool. Further, the second pin can engage a hole defined by a floor plate of the second firearm magazine. Thus, in some embodiments, a tool described herein can be used to remove the floor plate of a plurality of firearm magazines, the magazines differing in size and/or configuration.

In addition, in some cases, a tool described herein can further comprise one or more additional features or members. For example, in some instances, a tool described herein can further comprise a punch member and/or a brush member. The punch member and/or the brush member can be attached to the first and/or second gripping member of the tool and, if desired, can extend from the gripping member in a direction that is substantially parallel to the long axis of the first or second elongated pin. A tool comprising such a punch member and/or a brush member can, in some implementations, be used to perform one or more additional cleaning, repair, and/or maintenance tasks, as described further hereinbelow.

In another aspect, methods of removing the floor plate of a firearm magazine are described herein which, in some embodiments, may provide one or more advantages over other methods. For example, in some cases, a method described herein is safer, simpler, faster, and/or more efficient than some other methods.

In some embodiments, a method of removing the floor plate of a firearm magazine comprises providing a firearm magazine and providing a magazine floor plate removal tool. The firearm magazine comprises a floor plate and defines a surface adjacent the floor plate, and the floor plate defines a hole. The magazine floor plate removal tool can comprise a tool described herein. For example, in some instances, the tool comprises a handle having a first end and a second end and a first gripping member that grips or receives the firearm magazine. The first gripping member can comprise a first arm extending from the first end of the handle and a second arm extending from the first end of the handle. The terminus of the first arm can comprise an elongated first pin that has a long axis and engages the hole of the floor plate. The terminus of the second arm can comprise a first engagement surface that is positioned substantially parallel to the long axis of the first pin and engages the surface of the magazine adjacent the floor plate. In addition, the first pin and the first engagement surface can be separated by a first distance.

A method described herein can also comprise inserting the first pin of the tool into the hole of the floor plate and contacting the first engagement surface of the tool with the surface of the magazine adjacent the floor plate. In some embodiments, the method further comprises applying a downward force and a turning, or rotational, force to the first gripping member sufficient to slide the floor plate toward the first engagement surface of the tool. Thus, in some implementations, a method described herein can be used to remove the floor plate of a firearm magazine in a safe, simple, rapid, and/or efficient manner.

These and other embodiments are described in greater detail in the detailed description which follows.

BRIEF DESCRIPTION OF THE FIGURES

The drawings referenced herein form a part of the specification. Features shown in the drawings are meant as illustrative of some, but not all, embodiments of the invention, unless otherwise explicitly indicated, and implications to the contrary are otherwise not to be made. Although in the drawings like reference numerals correspond to similar, though not necessarily identical, components and/or features, for the sake of brevity, reference numerals or features having a previously described function may not necessarily be described in connection with other drawings in which such components and/or features appear.

DETAILED DESCRIPTION

In the following detailed description of representative embodiments of the invention, reference is made to the accompanying drawings that form a part hereof, and in which are shown by way of illustration specific examples of embodiments in which the invention may be practiced. While these embodiments are described in sufficient detail to enable those skilled in the art to practice the invention, it will nevertheless be understood that no limitation of the scope of the present invention is thereby intended. Alterations and further modifications of the features illustrated herein, and additional applications of the principles illustrated herein, which would occur to one skilled in the relevant art and having possession of this invention, are to be considered within the scope of this invention. Specifically, other embodiments may be utilized, and logical, mechanical, material, and other changes may be made without departing from the spirit or scope of the present invention.

Accordingly, the following detailed description is not to be taken in a limiting sense, and the scope of the present invention is defined by the appended claims.

In addition, all ranges disclosed herein are to be understood to encompass any and all subranges subsumed therein. For example, a disclosed range of "1.0 to 10.0" should be considered to include any and all subranges beginning with a minimum value of 1.0 or more and ending with a maximum value of 10.0 or less, e.g., 1.0 to 5.3, or 4.7 to 10.0, or 3.6 to 7.9.

Figure 3:
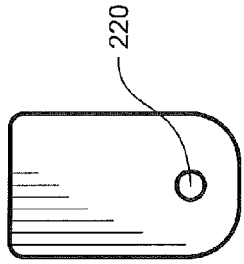
FIG. 3 illustrates a plan view of the firearm magazine of FIG. 2.
Figure 2:
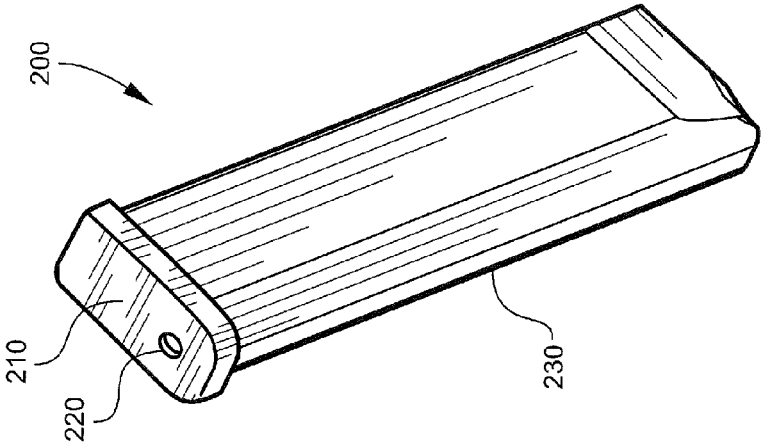
FIG. 2 illustrates a perspective view of a firearm magazine suitable for use in some embodiments of tools and methods described herein.
Figure 1:
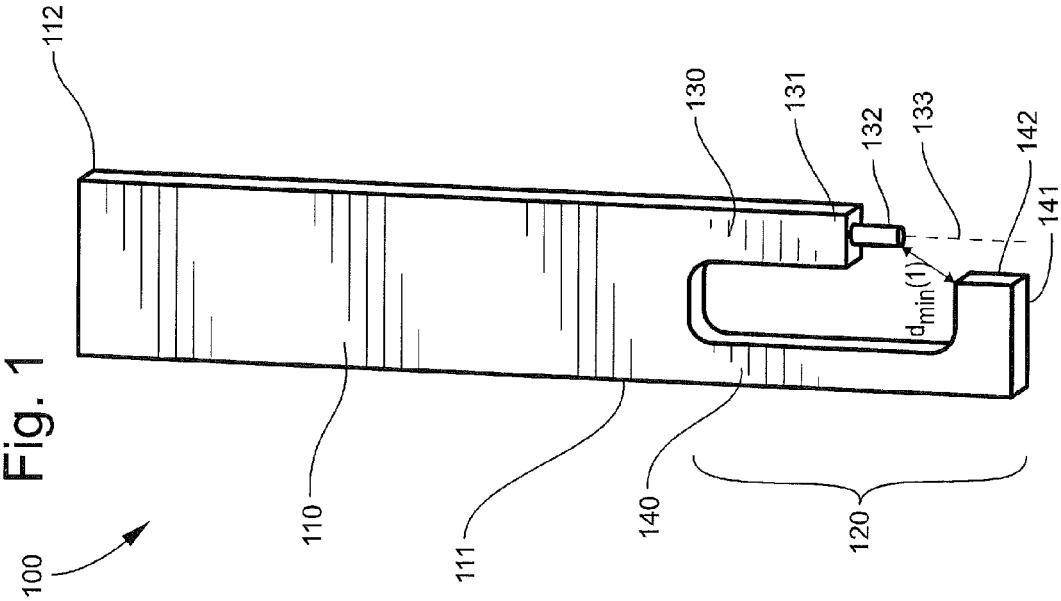
FIG. 1 illustrates a perspective view of a tool according to one embodiment described herein.

Some embodiments will now be described with reference to the drawings. As shown in FIGS. 1-3, one example implementation of the present invention includes a magazine floor plate removal tool (100) for removing the floor plate (210) of a firearm magazine (200). The floor plate (210) defines a hole (220), and the magazine (200) defines a surface (230) adjacent the floor plate (210).

The tool (100) comprises a handle (110) having a first end (111) and a second end (112). The tool (100) also comprises a first gripping member (120) that can grip or receive the firearm magazine (200). The gripping member (120) comprises a first arm (130) and a second arm (140) extending from the first end (111) of the handle (110). The terminus (131) of the first arm (130) comprises an elongated first pin or dowel (132) that has a long axis (133) and can engage the hole (220) of the floor plate (210). The terminus (141) of the second arm (140) comprises a first engagement surface (142) that is positioned substantially parallel to the long axis (133) of the first pin (132) and can engage the surface (230) of the magazine (200) adjacent the floor plate (210). For reference purposes herein, a substantially parallel surface comprises a surface that is positioned within about 20 degrees, within about 10 degrees, or within about 5 degrees of the parallel orientation.

Moreover, in the embodiment of FIG. 1, the first (130) and second (140) arms have different lengths. Specifically, the first arm (130) is shorter than the second arm (140). In addition, the second arm (140) extends farther from the first end (111) of the handle (110) in the direction of the long axis (133) of the first pin (132) than the first arm (130) does. Thus, in this configuration, the first engagement surface (142) is positioned below the first pin (132), where the term "below" refers to placement at a larger distance from the first end (111) of the handle (110) in the direction of the long axis (133) of the first pin (132). However, other configurations of the first (130) and second (140) arms are also possible.

In addition, as illustrated in FIG. 1, the first pin (132) is separated from the first engagement surface (142) by a first distance ($d_{min}(1)$). In some embodiments, the first distance ($d_{min}(1)$) is the minimum distance between the first pin (132) and the first engagement surface (142). Moreover, altering the configuration of the first arm (130) and/or the second arm (140), in some embodiments, can alter the first distance ($d_{min}(1)$). Thus, the first distance ($d_{min}(1)$) can be configured as desired to receive or grip a firearm magazine (200) having a specific size and/or shape. The firearm magazine (200) can comprise any magazine not inconsistent with the objectives of the present invention. For example, in some embodiments, the firearm magazine comprises a pistol magazine such as a GLOCK® pistol magazine. Further, the firearm magazine can comprise a variety of styles of floor plates, including floor plates having an extended finger groove or floor plates adapted for magazines having additional or expanded ammunition capacity.

Figure 4:
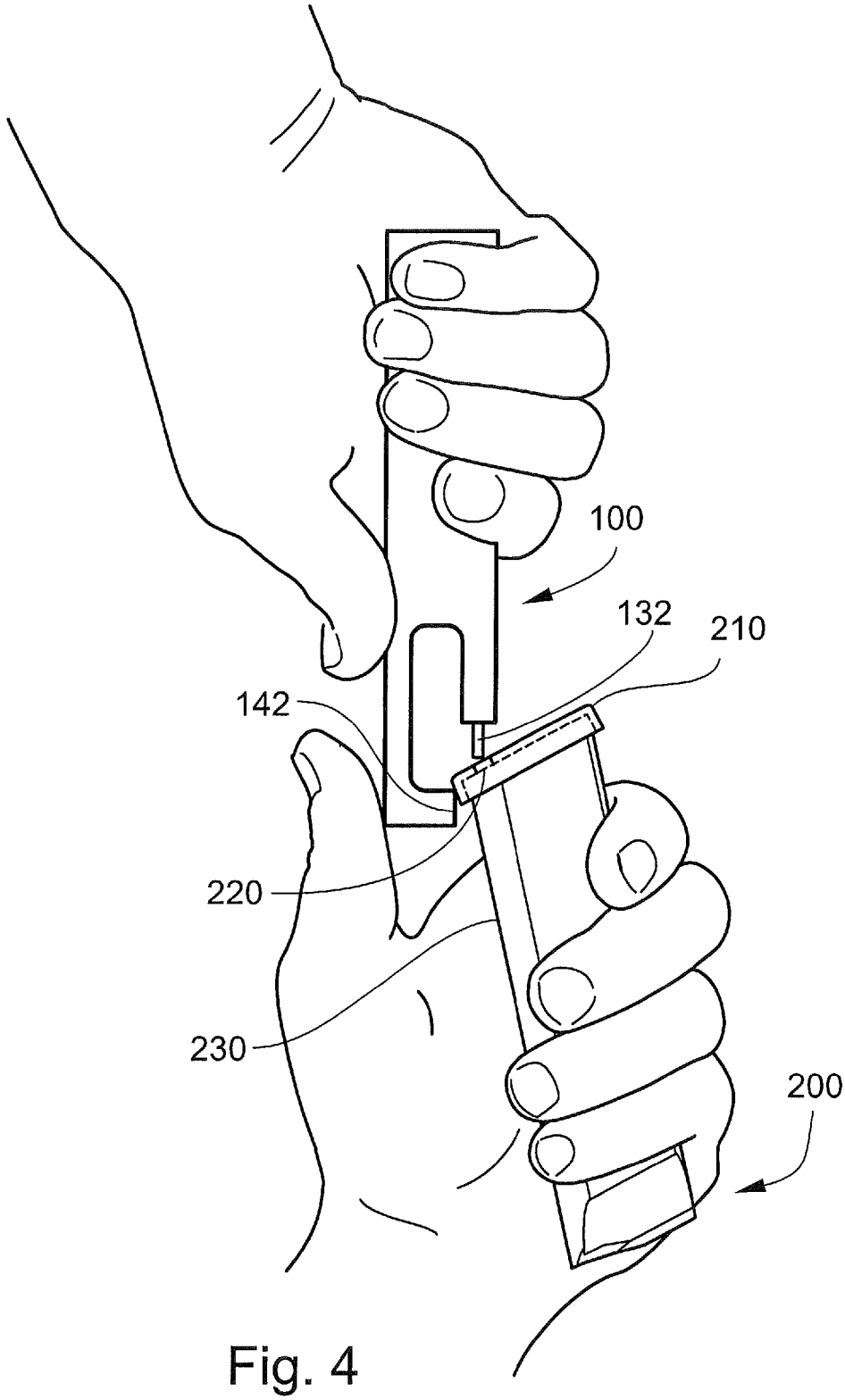
FIG. 4 illustrates the performing of a step of a method according to one embodiment described herein.
Figure 5:
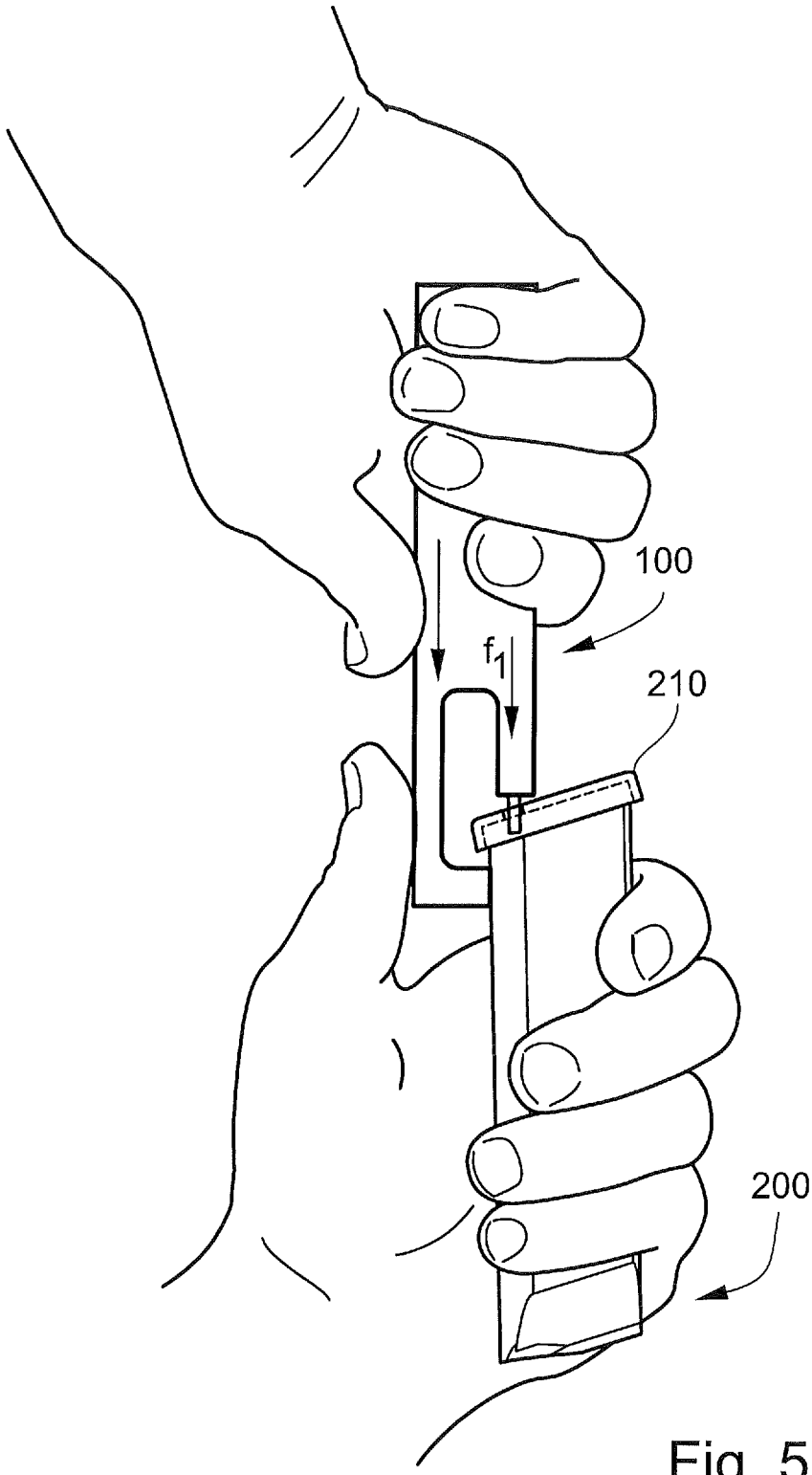
FIG. 5 illustrates the performing of a further step of the method of FIG. 4.
Figure 6:
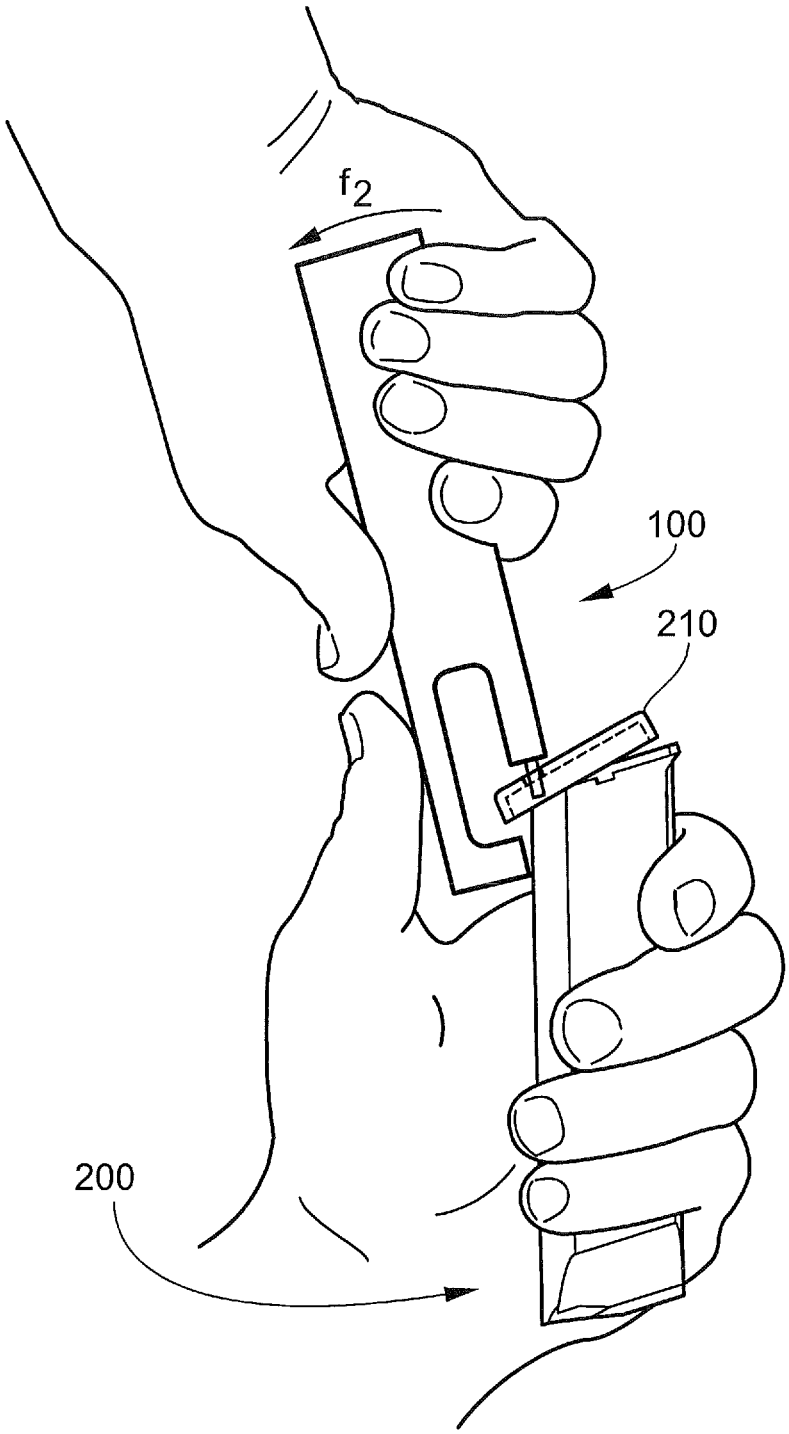
FIG. 6 illustrates the performing of a further step of the method of FIG. 4 and FIG. 5.

As illustrated in FIGS. 4-6, a tool (100) described herein can be used to remove the floor plate (210) of a firearm magazine (200) received or gripped by the tool (100). Specifically, in some embodiments, the floor plate (210) of the magazine (200) can be removed from the magazine (200) by inserting the first pin (132) of the tool (100) into the hole (220) of the floor plate (210) (as illustrated in FIGS. 4 and 5), contacting the first engagement surface (142) of the tool (100) with the surface (230) of the magazine (200) adjacent the floor plate (210) (as illustrated in FIGS. 4 and 5), and applying a downward force ($f_1$) and a turning force ($f_2$) to the gripping member of the tool (100) to slide the floor plate (210) toward the first engagement surface (142) of the tool (100) (as illustrated in FIGS. 5 and 6).

The various steps of the foregoing method of removing the floor plate of a firearm magazine can be carried out in any manner not inconsistent with the objectives of the present invention. For example, in some embodiments, one or more steps are carried out manually. However, it is also possible for one or more steps to be carried out in a machine-assisted or automated manner if desired.

Figure 7:
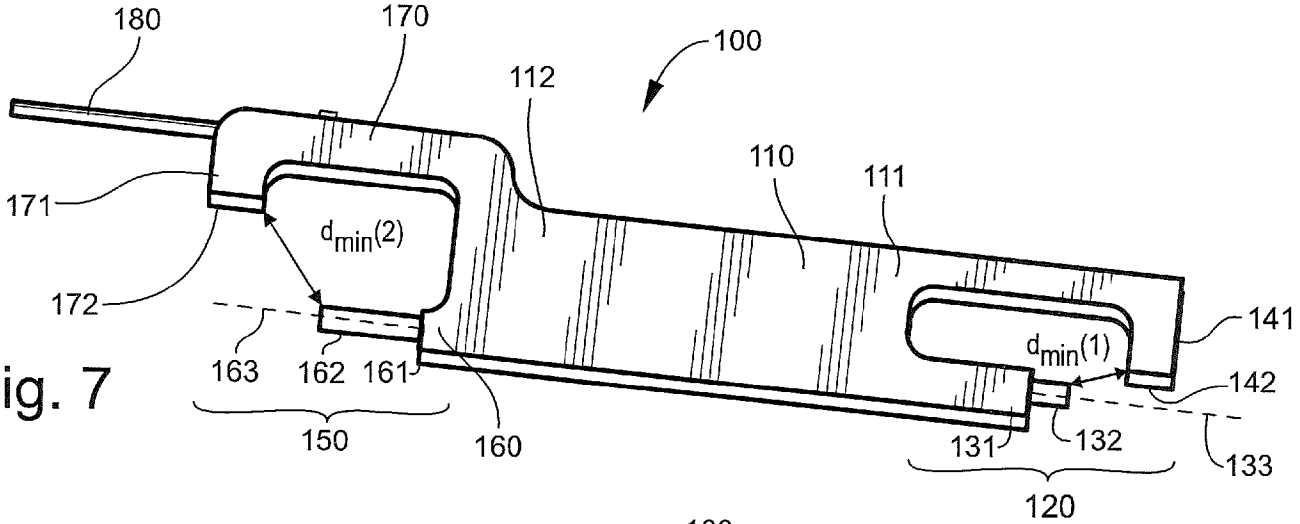
FIG. 7 illustrates a perspective view of a tool according to one embodiment described herein.

FIG. 7 illustrates a perspective view of a tool according to another embodiment described herein. The tool (100) comprises a handle (110) having a first end (111) and a second end (112). The tool (100) also comprises a first gripping member (120) that can grip or receive a firearm magazine (not shown). The first gripping member (120) comprises a first arm (130) and a second arm (140) extending from the first end (111) of the handle (110). The terminus (131) of the first arm (130) comprises an elongated first pin or dowel (132) that has a long axis (133) and can engage the hole of a floor plate of the magazine (not shown). The terminus (141) of the second arm (140) comprises a first engagement surface (142) that is positioned substantially parallel to the long axis (133) of the first pin (132) and can engage the surface of the magazine adjacent the floor plate (not shown).

In addition, the tool of FIG. 7 further comprises a second gripping member (150). The second gripping member (150) comprises a third arm (160) extending from the second end (112) of the handle (110) and a fourth arm (170) extending from the second end (112) of the handle (110). The terminus (161) of the third arm (160) comprises a second elongated pin or dowel (162) having a long axis (163). The terminus (171) of the fourth arm (170) comprises a second engagement surface (172) positioned substantially parallel to the long axis (163) of the second pin (162).

Moreover, in the embodiment of FIG. 7, the third (160) and fourth (170) arms have different lengths. Specifically, the third arm (160) is shorter than the fourth arm (170). In addition, the fourth arm (170) extends farther from the second end (112) of the handle (110) in the direction of the long axis (163) of the second pin (162) than the third arm (160) does. Thus, in this configuration, the second engagement surface (172) is positioned below the second pin (162), where the term "below" refers to a larger distance from the second end (112) of the handle (110) in the direction of the long axis (163) of the second pin (162). However, other configurations of the third (160) and fourth (170) arms are also possible.

As illustrated in FIG. 7, the first pin (132) is separated from the first engagement surface (142) by a first distance ($d_{min}(1)$) and the second pin (162) is separated from the second engagement surface (172) by a second distance ($d_{min}(2)$). In some embodiments, the first distance ($d_{min}(1)$) and/or the second distance ($d_{min}(2)$) is the minimum distance between the first pin (132) and the first engagement surface (142) and/or the minimum distance between the second pin (162) and the second engagement surface (172), respectively. In the embodiment of FIG. 7, the first distance ($d_{min}(1)$) and the second distance ($d_{min}(2)$) are different. Thus, if desired, the tool (100) can be used to grip or receive a plurality of firearm magazines differing in size and/or shape. For example, in some embodiments, the first gripping member (120) of the tool (100) can be used to grip or receive a first firearm magazine having a first size or shape, and the second gripping member (150) of the tool (100) can be used to grip or receive a second firearm magazine having a second size or shape that differs from the first size or shape of the first magazine.

Therefore, if desired, a tool described herein comprising two gripping members can be used to remove the floor plate of a plurality of firearm magazines differing in size and/or shape. Specifically, each gripping member can be used independently to remove a firearm magazine floor plate in a manner similar to the method illustrated in FIGS. 4-6.

Additionally, a tool described herein can also comprise one or more other features or components, including one or more features or components that may provide additional functionality to the tool. For example, in the embodiment of FIG. 7, the tool (100) further comprises a punch member (180). The punch member (180) comprises a rigid metal punch, rod, dowel, or screwdriver-type shaft that can be used to perform various mechanical operations, such as applying pressure or rotational force to an object. For example, the punch member (180) can be used to insert and/or remove one or more screws or pins of a firearm or firearm magazine described herein.

In the embodiment of FIG. 7, the punch member (180) extends in a direction that is substantially parallel to the long axis (163) of the second pin (162). For reference purposes herein, a substantially parallel direction is a direction that is within about 20 degrees, within about 10 degrees, or within about 5 degrees of the parallel direction. Other configurations of a punch member described herein are also possible.

Similarly, in some cases, a tool described herein can further comprise a brush member. A brush member, in some embodiments, comprises a wire brush that can be used to clean one or more components of a firearm or firearm magazine, including the interior portion of the magazine or the interior portion of another component of the firearm such as the barrel of the firearm.

Figure 8:
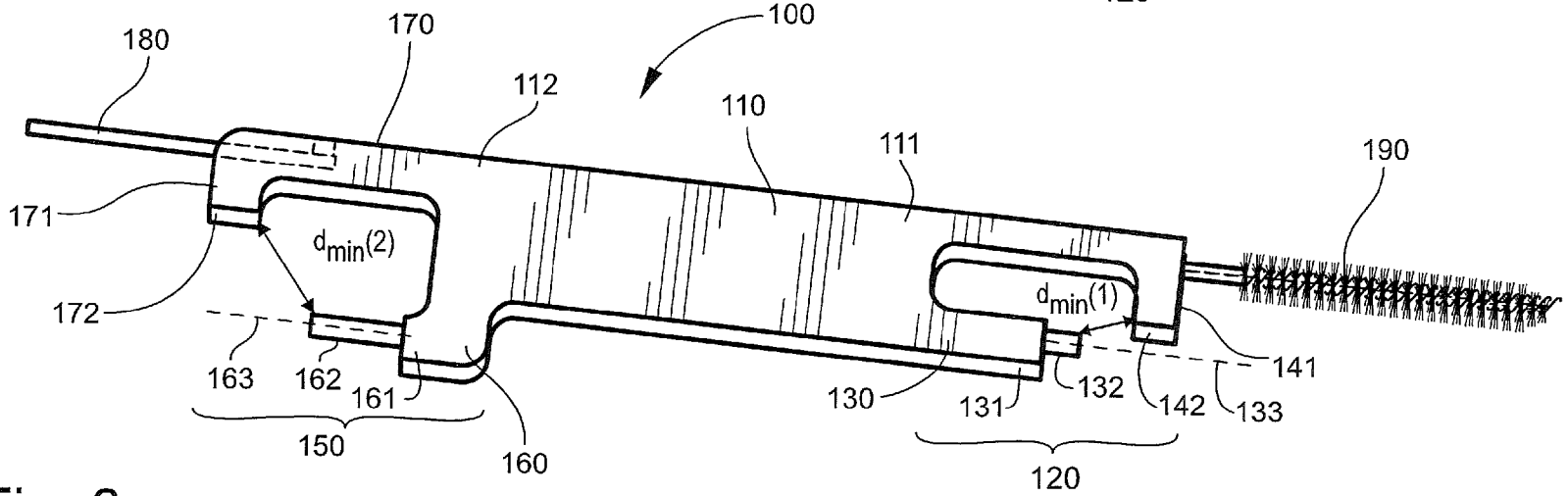
FIG. 8 illustrates a perspective view of a tool according to one embodiment described herein.

FIG. 8 illustrates one implementation of a tool comprising both a punch member and a brush member. As illustrated in FIG. 8, the tool (100) comprises a handle (110) having a first end (111) and a second end (112). The tool (100) also comprises a first gripping member (120) that can grip or receive a firearm magazine (not shown). The first gripping member (120) comprises a first arm (130) and a second arm (140) extending from the first end (111) of the handle (110). The terminus (131) of the first arm (130) comprises an elongated first pin or dowel (132) that has a long axis (133) and can engage the hole of a floor plate of the magazine (not shown). The terminus (141) of the second arm (140) comprises a first engagement surface (142) that is positioned substantially parallel to the long axis (133) of the first pin (132) and can engage the surface of the magazine adjacent the floor plate (not shown). The tool (100) further comprises a brush member (190) attached to and extending from the first gripping member (120). In the embodiment of FIG. 8, the brush member (190) extends in a direction that is substantially parallel to the long axis (133) of the first pin (132). However, other configurations are also possible.

In addition, the tool of FIG. 8 also includes a second gripping member (150). The second gripping member (150) comprises a third arm (160) extending from the second end (112) of the handle (110) and a fourth arm (170) extending from the second end (112) of the handle (110). The terminus (161) of the third arm (160) comprises a second elongated pin or dowel (162) having a long axis (163). The terminus (171) of the fourth arm (170) comprises a second engagement surface (172) positioned substantially parallel to the long axis (163) of the second pin (162). The tool (100) further comprises a punch member (180) attached to and extending from the second gripping member (150).

A punch member and/or a brush member of a tool described herein can be attached to the tool or a gripping member of the tool in any manner not inconsistent with the objectives of the present invention. For example, in some embodiments, a gripping member or a component thereof defines a threaded hole, and a punch member and/or a brush member is a threaded member that is threadingly engaged in the threaded hole. Alternatively, in some implementations, a gripping member or component thereof can define an unthreaded hole and a punch member or brush member can be positioned in the unthreaded hole and retained by a set screw. Thus, in some embodiments, the punch member and/or brush member of a tool described herein can be easily removed and replaced as desired, including for storage or use of the tool. For instance, in some cases, a punch and/or brush member can be removed during use of the tool to remove a firearm magazine floor plate. The punch and/or brush member can then be replaced if desired to perform another operation, such as an assembling, disassembling, and/or cleaning operation described herein.

Figure 9:
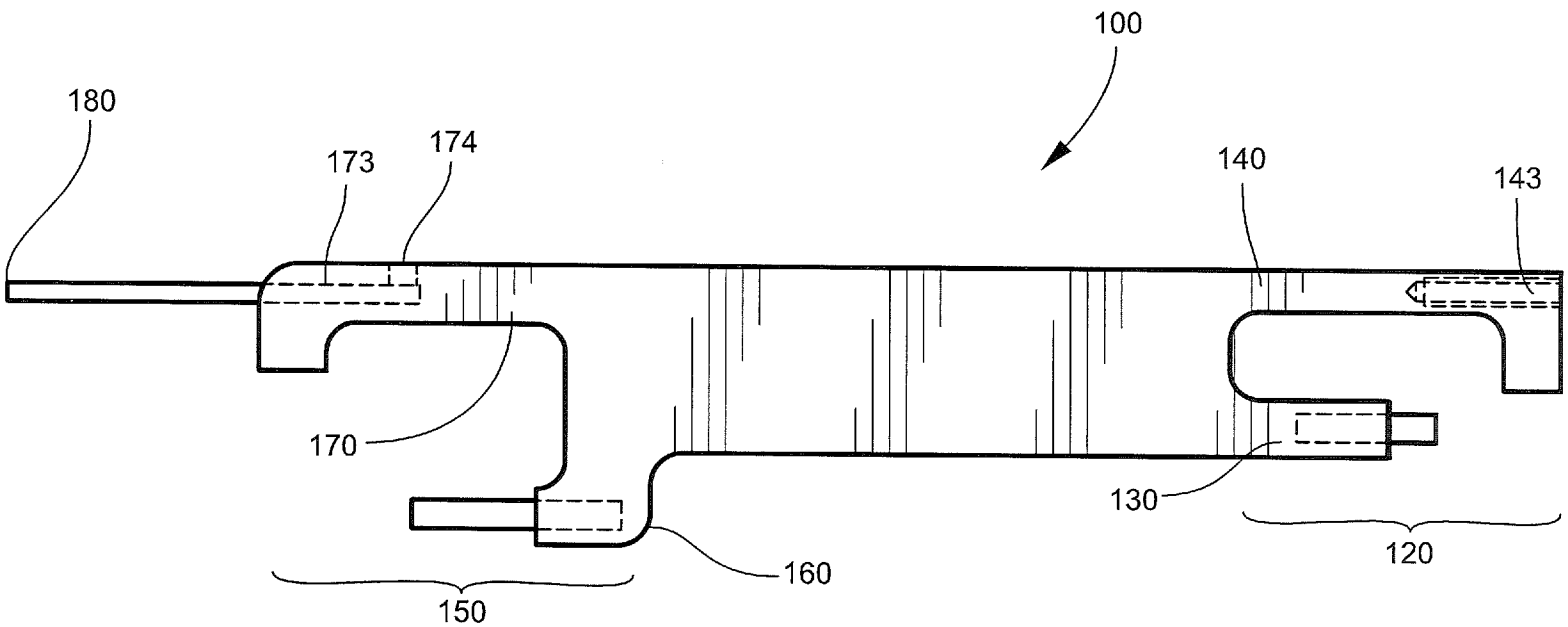
FIG. 9 illustrates a section view of a tool according to one embodiment described herein.

FIG. 9 illustrates one exemplary embodiment of a tool configured to include one or more additional functional members such as a punch member or a brush member. As illustrated in FIG. 9, the tool (100) comprises a first gripping member (120), a second gripping member (150), and a punch member (180). The first gripping member (120) comprises a first arm (130) and a second arm (140). The second arm (140) of the first gripping member (120) defines a threaded hole (143). The threaded hole (143) is configured to threadingly engage a threaded functional member such as a threaded punch member and/or a threaded brush member (not shown).

The second gripping member (150) comprises a third arm (160) and a fourth arm (170). The fourth arm (170) of the second gripping member (150) defines an unthreaded hole (173) and further comprises a set screw (174). The punch member (180) is positioned in the unthreaded hole (173) and is secured by the set screw (174).

As illustrated in FIG. 9, the threaded hole (143) is defined by the second arm (140) of the first gripping member (120) and the unthreaded hole (173) is defined by the fourth arm (170) of the second gripping member (150). However, other configurations are also possible. For example, a threaded hole can be defined by the second gripping member (150) or any component thereof, and an unthreaded hole can be defined by the first gripping member (120) or any component thereof.

In addition to the foregoing configurations, other configurations for attaching, retaining, and/or removing a punch member, brush member, or other functional member of a tool described herein are also possible, as understood by one of ordinary skill in the art.

Moreover, a punch member, brush member, or other functional member of a tool described herein can have any size or shape and be formed from any material not inconsistent with the objectives of the present invention. In some embodiments, for example, a punch member and/or a brush member has a length between about 1 inch (2.5 cm) and about 10 inches (25 cm) or between about 2 inches (5 cm) and about 5 inches (13 cm). Further, if desired, a punch member described herein can have a length and/or diameter that is the same or different than a length and/or diameter of an elongated pin of the tool. Moreover, in some embodiments, a punch member has a circular or cylindrical cross section. In other implementations, a punch member has a hexagonal or star-shaped cross section.

Additionally, in some cases, a punch member and/or a brush member is at least partially formed from a metal, including a mixture, combination, or alloy of metals. For instance, in some implementations, a punch member and/or a brush member is at least partially formed from aluminum or steel. Further, steel can include tool steel or carbon steel or stainless steel. In other instances, a punch member and/or a brush member is at least partially formed from a non-metal material such as a plastic material.

More generally, a tool or any portion of a tool described herein can comprise or be formed from any material not inconsistent with the objectives of the present invention. In some embodiments, a tool or a portion thereof comprises or is formed from a metal including a mixture, combination, or alloy of metals. For example, in some cases, a tool or portion thereof comprises or is formed from aluminum or steel. Further, steel can include tool steel or carbon steel or stainless steel. In other cases, a tool or a portion thereof comprises or is formed from a non-metal material.

Moreover, a tool or any portion thereof can be made or provided in any manner not inconsistent with the objectives of the present invention. In some implementations, a tool or a portion thereof is made by a casting, molding, forming, or cutting process. A casting process, in some embodiments, comprises die casting, sand casting, and/or shell casting. Similarly, a forming process can include cold sizing, drawing, and/or forging. A cutting process can comprise one or more of machining, drilling, turning, milling, grinding, or sawing. Other manufacturing processes may also be used, as understood by one of ordinary skill in the art.

Further, in some embodiments, a tool or a portion of a tool described herein can be coated with a coating material. For example, in some instances, the handle of a tool is coated with a coating material. In other instances, one or more gripping members or other functional members of a tool are coated with a coating material.

Any coating material not inconsistent with the objectives of the present invention may be used. In some embodiments, a coating material comprises an organic material such as a polymeric material. An organic or polymeric material, in some cases, comprises an epoxy composition. In other embodiments, a coating material comprises an inorganic material such as a metal, metal oxide, or ceramic material such as CERAKOTE®. A metal coating material can be a pure metal or an alloy or mixture of metals. In some cases, a tool or a portion of a tool described herein is coated with a metal plating. For example, in some instances, a tool or portion of a tool is coated with plated nickel. In other cases, a tool or portion of a tool is plated with gold, silver, rhodium, chrome, or a combination thereof. Metal plating can be carried out in any manner not inconsistent with the objectives of the present invention. In some embodiments, metal plating is carried out using electroplating or electroless plating.

Further, in some implementations, a tool or portion of a tool is coated with a non-slip coating, including an organic or inorganic non-slip coating. A non-slip coating, in some cases, comprises an epoxy composition or a rubber composition. Moreover, a non-slip coating useful in some embodiments described herein can be applied by a painting, dipping, or spraying process.

Additionally, a tool described herein can have any physical dimensions not inconsistent with the objectives of the present invention. In some embodiments, for instance, a tool described herein has a total length between about 4 inches (10 cm) and about 18 inches (46 cm) or between about 5 inches (13 cm) and about 12 inches (30 cm). In some implementations, a tool has a width between about 0.5 inches (1.3 cm) and about 3 inches (8 cm) or between about 1 inch (2.5 cm) and about 2 inches (5 cm). In some cases, a tool described herein has a thickness of less than 1 inch (2.5 cm) or less than about 0.5 inches (1.3 cm). In some embodiments, a tool has a thickness greater than about 1 inch (2.5 cm).

Various portions or subcomponents of tools described herein may also have any physical dimensions not inconsistent with the objectives of the present invention. For example, in some embodiments, an elongated pin described herein has a length between about 0.5 inches (1.3 cm) and about 3 inches (8 cm) and a diameter between about 1/16 inches (0.16 cm) and about 1/4 inches (0.64 cm). In addition, the diameter of an elongated pin, if desired, can correspond to the diameter of a hole of a floor plate of a firearm magazine described herein.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

That which is claimed is:

1. A magazine floor plate removal tool for removing the floor plate of a firearm magazine, the floor plate defining a hole, the magazine defining a surface adjacent the floor plate, and the tool comprising:

a handle having a first end and a second end; and a first gripping member that grips the firearm magazine, the gripping member comprising:

a first arm extending from the first end of the handle; and a second arm extending from the first end of the handle;

the terminus of the first arm including an elongated first pin that has a long axis and engages the hole of the floor plate, the elongated first pin being positioned within 10 degrees of a direction parallel to the handle;

the terminus of the second arm including a first engagement surface that is positioned substantially parallel to the long axis of the first pin and engages the surface of the magazine adjacent the floor plate; and the first pin and the first engagement surface being separated by a first distance.

2. The tool of claim 1, wherein the second arm extends farther from the first end of the handle in the direction of the long axis of the first pin than the first arm does.

3. The tool of claim 1 further comprising:

a second gripping member, the second gripping member comprising:

a third arm extending from the second end of the handle; and a fourth arm extending from the second end of the handle;

the terminus of the third arm including a second elongated pin having a long axis;

the terminus of the fourth arm including a second engagement surface positioned substantially parallel to the long axis of the second pin; and the second pin and the second engagement surface being separated by a second distance.

4. The tool of claim 3, wherein the first distance and the second distance are different.

5. The tool of claim 3, wherein the fourth arm extends farther from the handle of the tool in the direction of the long axis of the second pin than the third arm does.

6. The tool of claim 1 further comprising:

a punch member or a brush member.

7. The tool of claim 1 further comprising:

a punch member; and a brush member.

8. The tool of claim 6, wherein the first gripping member defines a threaded hole and the punch member or the brush member is a threaded member threadingly engaged in the threaded hole.

9. The tool of claim 6, wherein the first gripping member defines an unthreaded hole and further comprises a set screw, the punch member or the brush member being positioned in the unthreaded hole and secured by the set screw.

10. The tool of claim 1, wherein the tool or a portion of the tool is coated with a coating material.

11. The tool of claim 10, wherein the coating material comprises a non-slip coating material.

12. A method of removing the floor plate of a firearm magazine comprising:

providing a firearm magazine comprising a floor plate, the floor plate defining a hole and the magazine defining a surface adjacent the floor plate;

providing a magazine floor plate removal tool, the tool comprising:

a handle having a first end and a second end; and a first gripping member that grips the firearm magazine, the gripping member comprising:

a first arm extending from the first end of the handle; and a second arm extending from the first end of the handle;

wherein the terminus of the first aim comprises an elongated first pin that has a long axis and engages the hole of the floor plate, the elongated first pin being positioned within 10 degrees of a direction parallel to the handle, wherein the terminus of the second arm comprises a first engagement surface that is positioned substantially parallel to the long axis of the first pin and engages the surface of the magazine adjacent the floor plate, and wherein the first pin and the first engagement surface are separated by a first distance;

inserting the first pin of the tool into the hole of the floor plate;

contacting the first engagement surface of the tool with the surface of the magazine adjacent the floor plate; and applying a downward force and a rotational force to the gripping member sufficient to slide the floor plate toward the first engagement surface of the tool.

* * * * *